US006938728B2

(12) United States Patent
Chae et al.

(10) Patent No.: US 6,938,728 B2
(45) Date of Patent: Sep. 6, 2005

(54) METHOD AND APPARATUS FOR ATTACHING A RESONANCE CHAMBER TO AN AIR INDUCTION COMPONENT

(75) Inventors: David J. Chae, Windsor (CA); Bryan P. Bestvater, Essex (CA); Brian DeBacker, Chatham (CA); Arden G. Stass, Blenheim (CA); Jason Pettipiece, Chatham (CA)

(73) Assignee: Siemens VDO Automotive Inc., Chatham (CA)

( * ) Notice: Subject to any disclaimer, the term of this patent is extended or adjusted under 35 U.S.C. 154(b) by 16 days.

(21) Appl. No.: 10/308,684

(22) Filed: Dec. 3, 2002

(65) Prior Publication Data

US 2003/0102183 A1 Jun. 5, 2003

Related U.S. Application Data

(60) Provisional application No. 60/336,769, filed on Dec. 3, 2001.

(51) Int. Cl.[7] ..... F02M 35/00; F02M 35/10

(52) U.S. Cl. ..... 181/229; 181/240; 123/184.53; 123/184.57

(58) Field of Search ..... 181/229, 240, 181/250; 123/184.53, 184.57, 184.56, 184.52, 184.32

(56) References Cited

U.S. PATENT DOCUMENTS 3,998,614 A * 12/1976 Schonberger et al. ..... 55/417
4,281,741 A * 8/1981 Blaser et al. ..... 181/250
4,342,373 A * 8/1982 Erickson et al. ..... 181/266
4,779,415 A * 10/1988 Richardson et al. ..... 181/240
4,782,912 A * 11/1988 Wandless ..... 181/229
5,163,387 A * 11/1992 Lee ..... 123/184.38
5,333,576 A 8/1994 Verkleeren
5,349,141 A * 9/1994 Horibe et al. ..... 181/224
5,424,494 A * 6/1995 Houle et al. ..... 181/229
5,477,819 A * 12/1995 Kopec ..... 123/184.42
5,559,308 A * 9/1996 Hayashi ..... 181/272
5,572,966 A * 11/1996 Doddy et al. ..... 123/184.57
5,628,287 A * 5/1997 Brackett et al. ..... 123/184.55
6,024,188 A * 2/2000 Yamaguchi et al. ..... 181/204
6,192,849 B1 * 2/2001 Powell ..... 123/184.34
6,213,077 B1 * 4/2001 Horii ..... 123/184.57
6,213,827 B1 * 4/2001 Hattori et al. ..... 440/89
6,508,331 B1 * 1/2003 Stuart ..... 123/184.57

* cited by examiner

*Primary Examiner*—David Martin
*Assistant Examiner*—Eduardo Colon Santana

(57) ABSTRACT

An air induction assembly includes a tuning tube that is integrally formed with an air duct having a distal tube end extending into a resonance chamber. The air duct includes a shoulder portion that transitions into a base end of the tuning tube. The shoulder portion has a greater diameter than the tuning tube and defines an external duct surface. The resonance chamber includes an opening for receiving the tuning tube. A flange surrounds the opening and defines an external resonance chamber surface. The external resonance chamber surface abuts against the external duct surface to define an attachment interface. The assembly is welded at the attachment interface to securely attach the resonance chamber to the air duct.

18 Claims, 1 Drawing Sheet

METHOD AND APPARATUS FOR ATTACHING A RESONANCE CHAMBER TO AN AIR INDUCTION COMPONENT

CROSS-REFERENCE TO RELATED APPLICATIONS

The application claims priority to U.S. Provisional Application No. 60/336,769, which was filed on Dec. 3, 2001.

BACKGROUND OF THE INVENTION

This invention relates to a method and apparatus for welding a resonance chamber to an air induction system component without adversely affecting tuning tube length.

Typically in an air induction system, tuning tubes are used to reduce undesirable noise and are positioned for communication between an air duct and a resonance chamber. Tuning tubes are designed to a specified length and diameter to achieve a desired tuning frequency. Traditionally, the air duct includes a first tuning tube half and the resonance chamber includes a second tuning tube half. The first and second tuning tube halves are abutted against each other and a weld is formed about the diameter of the tuning tube.

This traditional attachment method has several disadvantages. For example, improper welding can affect the frequency of the tuning tube. If too much pressure is exerted on the tube during the welding process, the overall length of the tube can change, which in turn changes the frequency. Improper welding can also result in leaking at the mid-section of the tuning tube, which can also adversely affect the frequency.

Thus, it is desirable to have a method and system for attaching a resonance chamber to an air duct component that does not vary the desired frequency of the associated tuning tube, as well as overcoming the other above mentioned deficiencies with the prior art.

SUMMARY OF THE INVENTION

An air induction system includes an air duct, a tuning tube supported by the air duct, and a resonance chamber that engages the air duct at an attachment interface. During assembly, the tuning tube is inserted through an opening in the resonance chamber such that a distal end of the tuning tube is positioned inside the resonance chamber. A weld area formed at the attachment interface to securely attach the air duct to the resonance chamber.

Preferably, the tuning tube is integrally formed with the air duct as one piece. A shoulder portion transitions from the air duct to a base end of the tuning tube. The shoulder has a greater diameter than the tuning tube and defines a first attachment surface. A flange is formed about the opening of the resonance chamber and is positioned adjacent to the base end of the tuning tube. The flange defines a second attachment surface with the first and second attachment surfaces being generally parallel to each other. The first attachment surface abuts the second attachment surface to define the attachment interface.

The subject system and method provides a more robust attachment between a resonance chamber and an air duct, and further provides an additional benefit of not compromising the tuning tube frequency during the assembly process. These and other features of the present invention can be best understood from the following specifications and drawings, the following of which is a brief description.

DETAILED DESCRIPTION OF A PREFERRED EMBODIMENT

Figure 1:
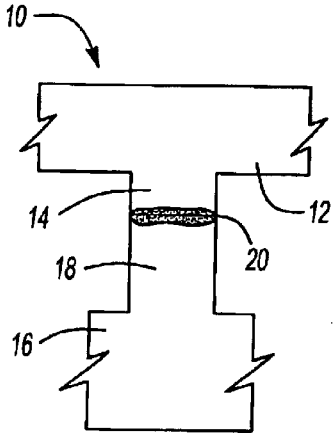
Fig-1 PRIOR ART
FIG. 1 is a schematic view of a traditional air duct tuning tube weld attachment.

A traditional induction system is shown generally at 10 in FIG. 1. The induction system 10 includes an air duct 12 that includes a first tuning tube half 14. A resonance chamber includes a chamber portion 16 and a second tuning tube half 18. In order to attach the resonance chamber to the air duct 12, the first 14 and second 18 tuning tube halves are welded together at 20. The tuning tube 14, 18 is tuned to a desired frequency to reduce noise. The desired frequency is determined by the length and diameter of the tuning tube.

Improper welding can affect the frequency of the tuning tube. For example, if too much pressure is exerted on the tube 14, 18 during the welding process, the overall length of the tube can change, which in turn changes the frequency.

Figure 2:
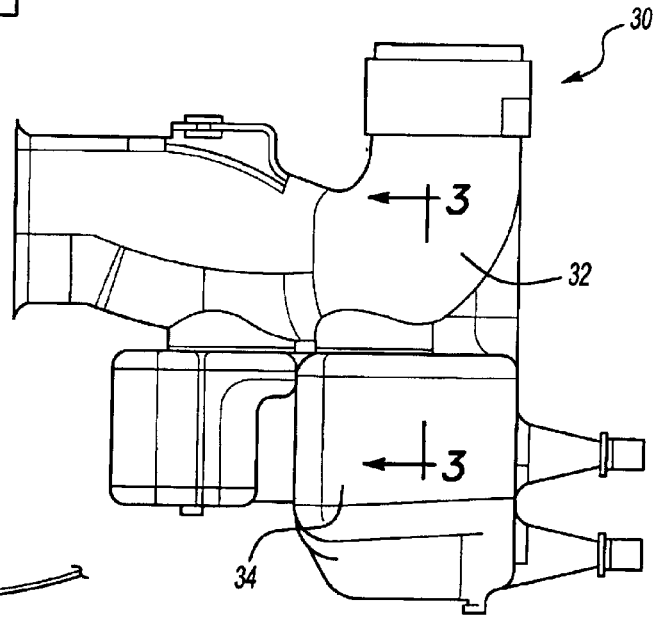
FIG. 2 is a side view of an air induction system incorporating the subject invention.
Figure 3:
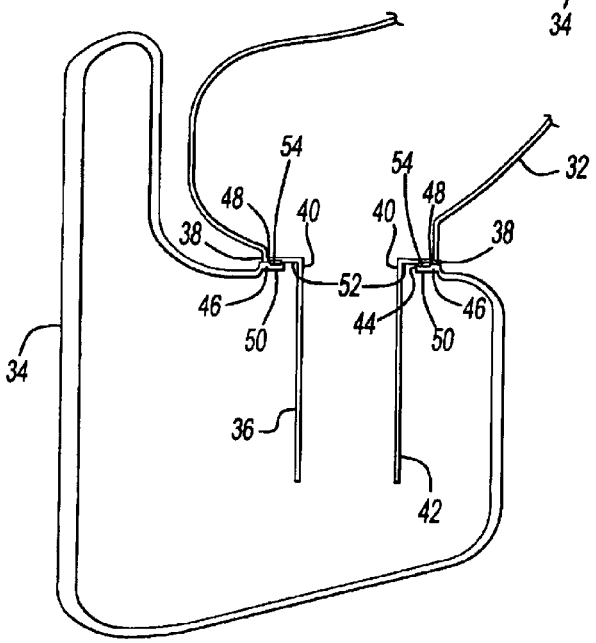
FIG. 3 is a cross-sectional view of FIG. 2 taken along line 3—3.

An improved air induction system is shown generally at 30 in FIG. 2. The induction system 30 includes an air duct 32 and a resonance chamber 34. As shown in the cross-sectional view of FIG. 3, the air duct 32 includes a tuning tube 36. The air duct 32 includes a shoulder portion 38 that transitions into a base end 40 of the tuning tube 36. A distal end 42 of the tuning tube 36 is received within the resonance chamber 34.

Preferably, the air duct 12 and the entire tuning tube 36 are integrally formed together as one piece. In other words, there is a contiguous, unbroken surface extending from the air duct 32 to the shoulder portion 38 to the distal end 42 of the tuning tube 36.

The resonance chamber 34 includes an opening 44 that is surrounded by a flange portion 46. The opening 44 has a diameter that is less than the diameter of the shoulder portion 38, and which is greater than the diameter of the tuning tube 36 such that the distal end 42 of the tuning tube 36 can be inserted through the opening 44 without interference during assembly.

The flange portion 46 includes an external surface 48 and an internal surface 50. The external surface 48 abuts against an external surface 52 of the shoulder portion 38 to define an attachment interface. The external surfaces 48, 52 are generally flat and parallel to each other.

A weld 54 is formed at the attachment interface to securely attach the resonance chamber 34 to the air duct 32. Preferably a hot-plate welding process is used, however, any type of welding process known in the art could also be used to attach the resonance chamber 34 to the air duct 32. Once the air duct 32 and resonance chamber 34 have been welded together, the opening 44 generally surrounds the base end 40 of the tuning tube 36.

As the attachment interface is separate from the tuning tube 36, the length of the tuning tube 36 is unaffected by the welding process. Thus, the frequency of the tube remains at a desired level after the welding operation has been completed. Also, because the attachment interface includes a shoulder portion 38 that transitions into the tuning tube 36, the weld itself is stronger, more rigid, and more robust than traditional air duct/tuning tube welds.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An air induction system comprising:

an air duct;

a tuning tube supported by said air duct wherein said air duct includes a main body portion with a shoulder portion transitioning into said tuning tube and wherein said main body portion includes an internal surface defining an inner cavity and an external surface including said shoulder portion with said shoulder portion having a greater diameter than said tuning tube;

a resonance chamber engaging said air duct at an attachment interface wherein said tuning tube is at least partially received within said resonance chamber; and a weld area formed at said attachment interface for securely attaching said air duct to said resonance chamber wherein said resonance chamber directly abuts against said external surface of said shoulder portion at said attachment interface with said attachment interface being formed solely between said shoulder portion and said resonance chamber.

2. A system as set forth in claim 1 wherein said tuning tube and said air duct are integrally formed as one piece.

3. A system as set forth in claim 1 wherein said tuning tube has a base end integrally formed with said shoulder portion and a distal end positioned within said resonance chamber.

4. A system as set forth in claim 3, wherein said shoulder portion has a greater diameter than said tuning tube.

5. An air induction system comprising:

an air duct;

a tuning tube supported by said air duct wherein said air duct includes a main body portion with a shoulder portion transitioning into said tuning tube, said shoulder portion having a greater diameter than said tuning tube;

a resonance chamber engaging said air duct at an attachment interface, said resonance chamber including a flanged portion surrounding an opening that receives said tuning tube wherein said tuning tube is at least partially received within said resonance chamber and wherein said tuning tube has a base end integrally formed with said shoulder portion and a distal end positioned within said resonance chamber; and a weld area formed at said attachment interface for securely attaching said air duct to said resonance chamber.

6. A system as set forth in claim 5 wherein said shoulder portion includes a first surface and said flange portion includes a second surface generally parallel to said first surface, said first and second surfaces cooperating to form said attachment interface.

7. A system as set forth in claim 5 wherein said opening has a greater diameter than said tuning tube and a smaller diameter than said shoulder portion.

8. An air induction system comprising:

an air duct;

a tuning tube integrally formed with said air duct as a single piece and extending to a distal tube end wherein said air duct includes a shoulder portion transitioning into a base end of said tuning tube with said shoulder portion having a greater diameter than said tuning tube;

a resonance chamber engaging said air duct at an attachment interface, said resonance chamber including a flange surrounding an opening that surrounds said base end of said tuning tube and wherein said distal tube end is positioned inside said resonance chamber; and a weld area formed at said attachment interface for securely attaching said air duct to said resonance chamber.

9. A system as set forth in claim 8 wherein said opening has a greater diameter than said tuning tube and a smaller diameter than said shoulder portion.

10. A method of attaching a resonance chamber to an air induction component comprising the steps of:

(a) providing an air duct with a tuning tube extending to a distal end and forming a shoulder portion for transitioning from the air duct to a base end of the tuning tube to define an external duct surface;

(b) inserting the distal end through an opening in the resonance chamber such that the external duct surface engages an external resonance chamber surface to define an attachment interface, forming a flange around the opening of the resonance chamber to define the external resonance chamber surface that is generally parallel to the external duct surface, and abutting the external resonance chamber surface against the external duct surface to form the attachment interface; and (c) welding at the attachment interface to attach the resonance chamber to the air duct.

11. A method as set forth in claim 10 including the step of integrally forming the air duct and tuning tube as a single piece.

12. A method as set forth in claim 10 wherein the opening surrounds the base end of the tuning tube.

13. An air induction system comprising:

an air duct;

a tuning tube supported by said air duct;

an air induction component for conducting air to a vehicle engine, said air induction component including at least said air duct and said tuning tube wherein said air duct and tuning tube are integrally formed together to define a contiguous unbroken surface extending from said air duct to a distal end of said tuning tube;

a resonance chamber engaging said air duct at an attachment interface wherein said tuning tube is at least partially received within said resonance chamber; and a weld area formed at said attachment interface for securely attaching said air duct to said resonance chamber.

14. A system as set forth in claim 13 wherein said air duct includes an internal surface forming an inner cavity for conducting air to the vehicle engine and an external surface forming a shoulder portion that has a greater diameter than said tuning tube and wherein said resonance chamber directly abuts against said external surface at said attachment interface.

15. An air induction system comprising:

an air duct;

a tuning tube integrally formed with said air duct as a single piece and extending to a distal tube end;

an air induction component for conducting air to a vehicle engine, said air induction component including at least said air duct and said tuning tube wherein said air duct and tuning tube define a contiguous unbroken surface extending from said air duct to said distal end of said tuning tube;

a resonance chamber engaging said air duct at an attachment interface wherein said distal tube end is positioned inside said resonance chamber; and a weld area formed at said attachment interface for securely attaching said air duct to said resonance chamber.

16. A system as set forth in claim 15 wherein said resonance chamber includes a flange and said air duct includes a shoulder portion that has a greater diameter than said tubing said and wherein said attachment interface is formed solely between an external surface of said shoulder portion and an external surface of said flange.

17. A method of attaching a resonance chamber to an air induction component comprising the steps of:

(a) providing an air induction component for conducting air to a vehicle engine including at least an air duct and a tuning tube extending to a distal end, integrally forming the air duct and tuning tube as a single piece, and forming a contiguous unbroken surface from an external duct surface to the distal end of the tuning tube;

(b) inserting the distal end through an opening in the resonance chamber such that the external duct surface engages an external resonance chamber surface to define an attachment interface; and (c) welding at the attachment interface to attach the resonance chamber to the air duct.

18. An air induction system comprising:

an air duct;

a tuning tube integrally formed with said air duct as a single piece and extending to a distal tube end wherein said air duct includes a shoulder portion transitioning into a base end of said tuning tube with said shoulder portion having a greater diameter than said tuning tube;

a resonance chamber engaging said air duct at an attachment interface wherein said distal tube end is positioned inside said resonance chamber; and a weld area formed at said attachment interface for securely attaching said air duct to said resonance chamber wherein said resonance chamber includes a flange that directly abuts against an external surface of said shoulder portion with said weld area being formed solely between said flange and said shoulder portion.

* * * * *